US011219113B2

(12) United States Patent
Jegou et al.

(10) Patent No.: US 11,219,113 B2
(45) Date of Patent: Jan. 4, 2022

(54) RADIATION SOURCE

(71) Applicant: SMITHS HEIMANN SAS, Vitry sur Seine (FR)

(72) Inventors: Guillaume Jegou, Vitry sur Seine (FR); Christophe Mielot, Vitry sur Seine (FR)

(73) Assignee: SMITHS HEIMANN SAS, Vitry sur Seine (FR)

( * ) Notice: Subject to any disclaimer, the term of this patent is extended or adjusted under 35 U.S.C. 154(b) by 0 days.

(21) Appl. No.: 16/964,717

(22) PCT Filed: Jan. 23, 2019

(86) PCT No.: PCT/GB2019/050178
§ 371 (c)(1),
(2) Date: Jul. 24, 2020

(87) PCT Pub. No.: WO2019/145703
PCT Pub. Date: Aug. 1, 2019

(65) Prior Publication Data

US 2020/0352015 A1 Nov. 5, 2020

(30) Foreign Application Priority Data

Jan. 24, 2018 (GB) ..... 1801162

(51) Int. Cl.
*H01J 35/30* (2006.01)
*H01J 35/08* (2006.01)
(Continued)

(52) U.S. Cl.
CPC ..... *H05G 1/52* (2013.01); *H01J 35/16* (2013.01); *H01J 2235/081* (2013.01); *H01J 2235/086* (2013.01)

(58) Field of Classification Search
CPC ..... G01N 23/04; G01N 2223/04; G01N 2223/1016; G01N 2223/304;
(Continued)

(56) References Cited

U.S. PATENT DOCUMENTS 5,222,114 A 6/1993 Kamata et al.
2003/0185344 A1* 10/2003 Ukita ..... 378/143
(Continued)

FOREIGN PATENT DOCUMENTS

DE 102015210681 A1 12/2016
WO 2006003727 A1 1/2006

OTHER PUBLICATIONS

International Search Report and Written Opinion for PCT/GB2019/050178 dated May 28, 2019, 12pps.

*Primary Examiner* — Irakli Kiknadze
(74) *Attorney, Agent, or Firm* — Armstrong Teasdale LLP

(57) ABSTRACT

An inspection radiation source is provided. The inspection radiation source includes an electron accelerator for generating an electron current, and a target for the electron current including a first part and a second part. This first part is configured to be at least partly exposed to the electron current on an impact area having a first width in a direction substantially perpendicular to the electron current, and inhibit propagation of the electron current. The second part has a second width in the direction substantially perpendicular to the electron current, the second width of the second part being smaller than the first width of the impact area, the second part being configured to be at least partly exposed to the electron current, and generate inspection radiation by emitting X-rays in response to being exposed to the electron current.

15 Claims, 7 Drawing Sheets

(51) Int. Cl.
*H05G 1/52* (2006.01)
*H01J 35/16* (2006.01)

(58) Field of Classification Search
CPC ..... G01N 2223/419; G01N 2223/423; G01N 2223/505; G01N 2223/639; G01N 23/02; G01N 23/046; G01N 23/083; G01N 23/2252; G01N 23/085; G01N 23/2076; G01N 23/223; G01N 2223/076; G01N 2223/308; G01N 23/205; G01N 2223/206; G01N 2223/3301; G01N 23/043; G01N 23/087; G01N 23/005; G01N 23/20; G01N 33/54366; G01N 33/545; G01T 1/248; G01T 1/175; G01T 1/20; G01T 1/22; G01T 1/2985; G01T 7/08; G01T 3/06; G01T 1/247; H05H 2007/007; H05H 2007/082; H05H 13/04; H05H 2007/002; H05H 2007/048; H05H 9/00; H05H 11/00; H05H 2007/022; H05H 6/00; H05H 7/02; H05H 9/02; H05H 15/00; H05H 9/044; H05H 2007/025; H05H 2007/084; H05H 7/08; H05H 9/04; H05H 7/12; H05H 9/048; C23C 16/01; C23C 16/06; C23C 16/27; G21K 1/10; G21K 1/025; G21K 1/06; G21K 1/02; G21K 1/093; G21K 2201/061; G21K 2201/064; G21K 5/02; G21K 1/062; G21K 2201/062; G21K 5/00; G21K 5/10; G21K 5/04; G21K 1/067; G21K 1/087; G21K 5/08; H01J 2235/081; H01J 2235/086; H01J 35/116; H01J 35/16; H01J 2201/342; H01J 2235/06; H01J 2235/08; H01J 2235/164; H01J 35/065; H01J 35/08; H01J 35/147; H01J 35/32; H01J 35/14; H01J 2235/00; H01J 35/025; H01J 35/186; H01J 35/112; H01J 2235/16; H01J 35/00; H01J 2235/088; H01J 2235/10; H01J 2235/163; H01J 35/24; H01J 35/28; H01J 35/30; H01J 37/14; H01J 2235/068; H01J 35/066; H01J 2235/166; H01J 2235/205; H01J 35/02; H01J 35/064; H01J 35/153; H01J 35/305; H01J 2237/0435; H01J 2237/061; H01J 2237/06366; H01J 2237/06375; H01J 2237/3171; H01J 27/024; H01J 35/10; H01J 37/045; H01J 37/077; H01J 37/08; H01J 2237/202; H01J 37/317; H01J 2237/31; H01J 2237/3165; H01J 37/20; H01J 2237/2002; H01J 33/04; H01J 5/18; H05G 1/52; H05G 2/00; H05G 1/58; H05G 1/60; H05G 1/06; H05G 1/32; H05G 1/70; H05G 1/10; H05G 1/025; H05G 1/04; H05G 1/34; H05G 1/02; H05G 1/56; A61N 5/1001; A61N 5/1002; A61N 5/1048; A61N 2005/1054; A61N 2005/1062; A61N 5/1031; A61N 5/1049; A61N 2005/1061; A61N 5/10; A61N 2005/1087; A61N 5/1007; A61N 5/01; A61N 5/1081; A61N 2005/1005; A61N 2005/1089; A61N 2005/1091; A61N 2005/0627; A61N 2005/0659; A61N 2005/0661; A61N 2005/0662; A61N 2005/1022; A61N 2005/1098; G01V 5/0041; G01V 5/0066; G01V 5/0008; G01V 5/0016; G01V 5/0033; G01V 5/005; G01V 5/0069; G01V 5/0091; A61B 6/06; A61B 6/40; A61B 6/4085; A61B 6/4092; A61B 6/484; A61B 6/5258; A61B 5/0091; A61B 6/00; A61B 6/035; A61B 6/0414; A61B 6/4258; A61B 6/4283; A61B 6/481; A61B 6/502; A61B 6/542; A61B 6/545; A61B 6/025; A61B 6/405; A61B 6/4241; A61B 6/482; A61B 6/583; A61B 6/032; A61B 6/04; A61B 6/0435; A61B 6/506; A61B 6/508; A61B 6/4064; A61B 6/4208; A61K 49/0438; A61M 5/007; G21G 4/02; G01B 15/02; G01B 15/025; A61L 2/082; A61L 2202/14; A61L 2202/22; A61L 2202/23; A61L 2202/24; A61L 12/06; A61L 2/0041
USPC ..... 378/119, 115, 124, 137, 138, 143
See application file for complete search history.

(56) References Cited

U.S. PATENT DOCUMENTS

2014/0177800 A1* 6/2014 Sato ..... G01N 23/04 378/62
2017/0213686 A1* 7/2017 Ohashi ..... H01J 35/186

* cited by examiner

RADIATION SOURCE

CROSS-REFERENCE TO RELATED APPLICATIONS

This patent application is a National Stage Entry of PCT/GB2019/050178 filed on Jan. 23, 2019, which claims priority to GB Application No. 1801162.7 filed on Jan. 24, 2018, the disclosures of which are hereby incorporated by reference herein in their entirety as part of the present application.

BACKGROUND

The disclosure relates but is not limited to a source of inspection radiation. The disclosure also relates to a method of generating an inspection radiation.

As illustrated in FIG. 1, some inspection radiation sources 1 may include an electron accelerator 2 for generating an electron current 20, and a target 3 configured to generate the inspection radiation 30, by emitting X-rays in response to the target 3 being exposed to the electron current 20. The electron current 20 is generally such as the inspection radiation 30 originates from a volume called a focal spot 40, having a relatively large width W (e.g. typically 2 mm), e.g. in directions (Ox) and (Oy) substantially perpendicular to the electron current 20 as illustrated in FIGS. 1 and 2.

As a consequence a large fraction of the inspection radiation cannot be used to inspect e.g. cargo, but also contributes to decrease the image penetration and more generally the image quality, and also still increases the radiation safety perimeters. Radiation safety perimeters for apparatuses using the above inspection radiation sources are thus relatively large. Furthermore, collimators and/or shielding (the shielding being located e.g. behind detectors for the inspection radiation) are also relatively large for apparatuses using the above inspection radiation sources, in order to enable protection against e.g. lower intensity secondary radiation beams emitted on sides of a main inspection radiation beam (e.g. shadows). Collimators are also usually located relatively far from the accelerator, and are relatively heavy.

BRIEF DESCRIPTION

Aspects and embodiments of the disclosure are set out in the appended claims. These and other aspects and embodiments of the disclosure are also described herein.

BRIEF DESCRIPTION OF DRAWINGS

Embodiments of the disclosure will now be described, by way of example only, with reference to the accompanying drawings, in which.

In the drawings, like elements are referred to by the same numerical references.

DETAILED DESCRIPTION

Overview

Figure 3:
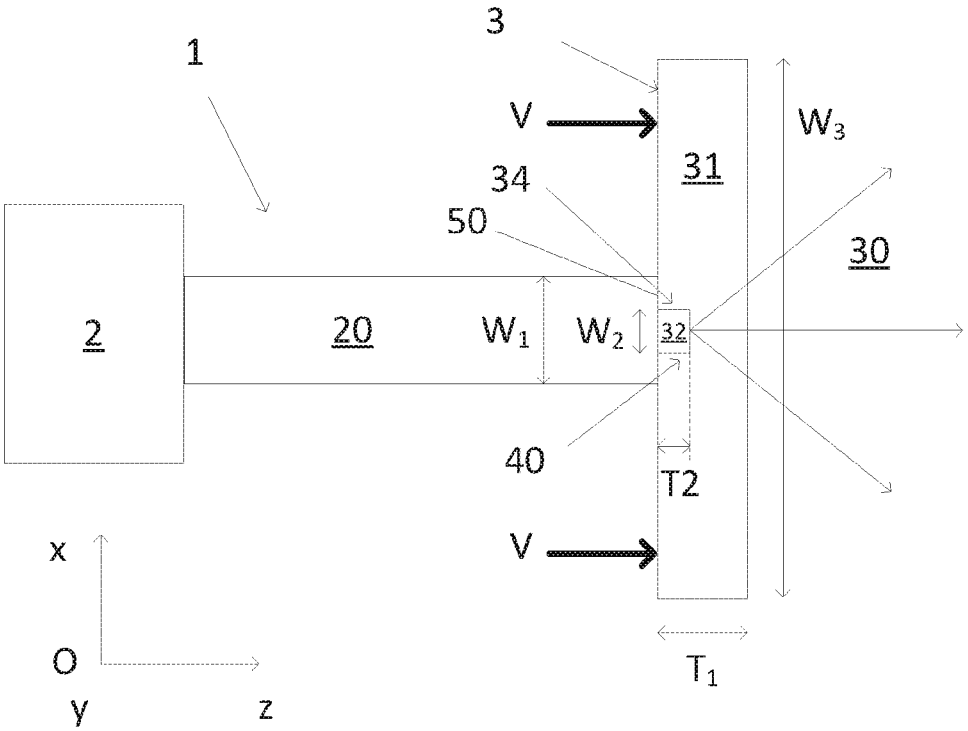
FIG. 3 schematically illustrates a first example inspection radiation source according to the present disclosure.

FIG. 3 schematically illustrates an inspection radiation source 1. The source 1 includes an electron accelerator 2 for generating an electron current 20. The source 1 also includes a target 3 configured to generate inspection radiation 30, e.g. using the phenomenon known as "bremsstrahlung". The target 3 may generate the inspection radiation 30 by emitting X-rays in response to the target 3 being exposed to the electron current 20.

The target 3 includes a first part 31 configured to be at least partly exposed to the electron current 20 on an impact area 50 having a first width $W_1$ in a direction (Ox) substantially perpendicular to the electron current 20 (e.g. substantially perpendicular to the direction (Oz) of FIG. 3). In the example of FIG. 3, the first part 31 is configured to inhibit propagation of the electron current 20, e.g. emitting an amount of X-rays which is negligible e.g. for inspection or detection purposes, as explained in greater detail below. In some examples, the first part 31 may be configured to absorb the electron current 20.

Figure 1:
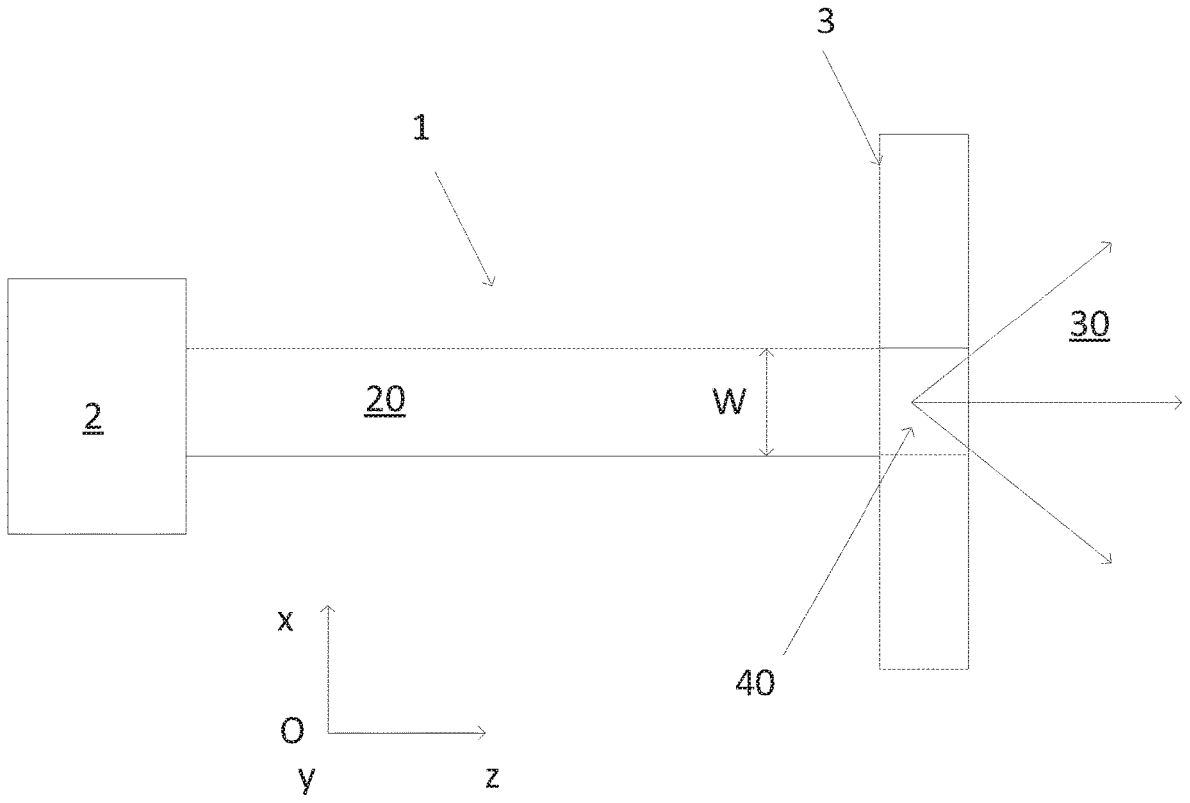
FIG. 1 schematically illustrates an inspection radiation source according to the prior art.
Figure 2:
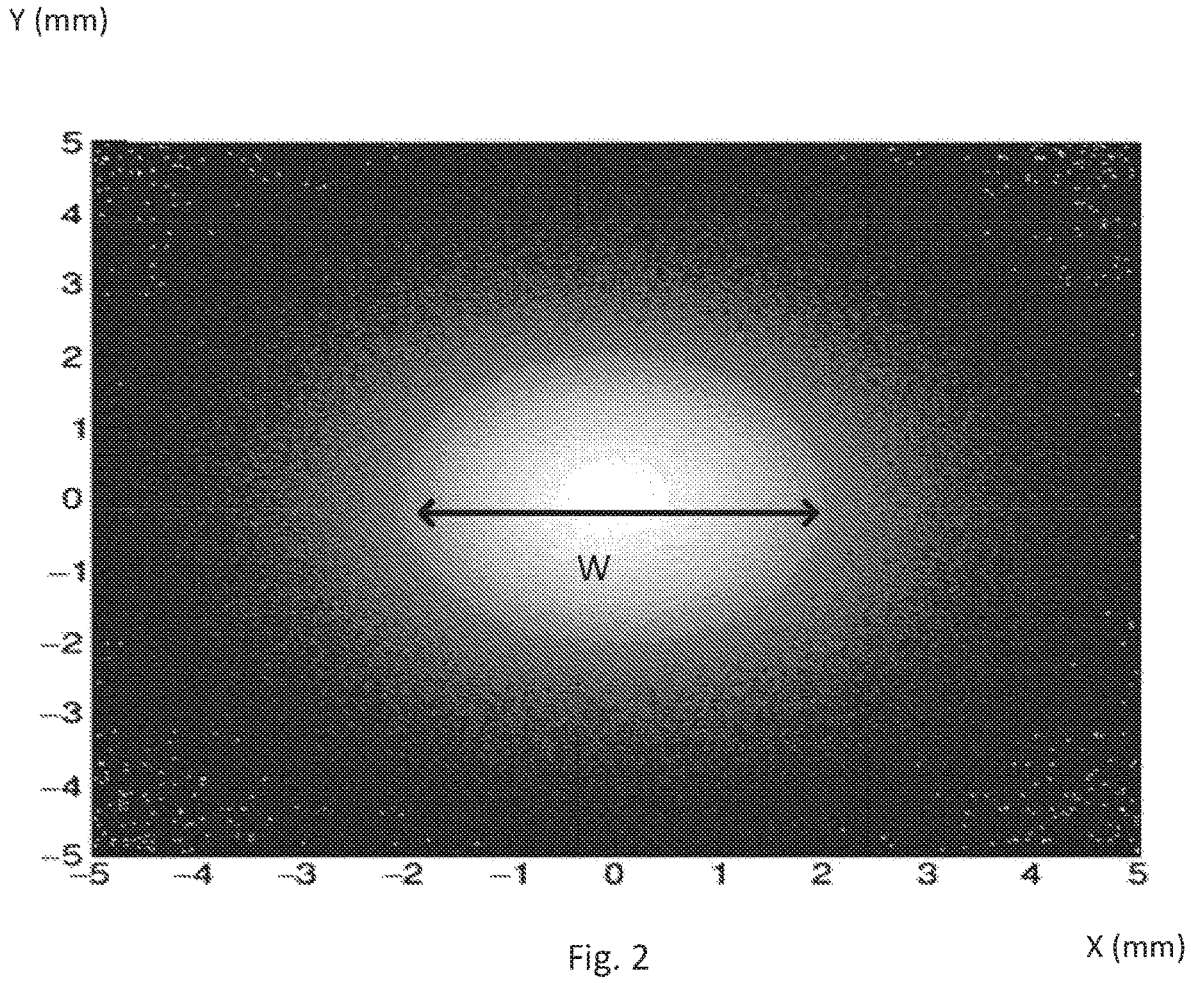
FIG. 2 schematically illustrates a spatial extension of a focal spot for a source according to FIG. 1, in which the central part corresponds to a high intensity of X-rays.

The target 3 also includes a second part 32 configured to be at least partly exposed to the electron current 20. The second part 32 has a second width $W_2$ in the direction (Ox) substantially perpendicular to the electron current 20. In the example of FIG. 2 the second width $W_2$ is smaller than the first width $W_1$ of the impact area 50, such that:

$$W_2<W_1.$$

In the example of FIG. 3, the second part 32 is configured to generate inspection radiation 30 by emitting X-rays in response to being exposed to the electron current 20. The second part 32 is associated with, e.g. corresponds to, the volume called the focal spot 40. The first part 31 includes a first material having a first atomic number, and the second part 32 includes a second material having a second atomic number greater than the first atomic number. In embodiments of the present disclosure, the first atomic number $Z_1$ and the second atomic number $Z_2$ may be such that:

$$Z_1<Z_2.$$

An intensity $I_2$ of the inspection radiation 30 generated by the second part 32 is substantially proportional to a square of the second atomic number of the second material of the second part 32. In embodiments of the present disclosure, the intensity $I_2$ of the inspection radiation 30 generated by the second part 32 is such that:

$$I_2 \propto Z_2^2.$$

Similarly, an intensity $I_1$ of inspection radiation (not shown in the Figures) generated by the first part 31 is substantially proportional to a square of the first atomic number of the first material of the first part 3, such that:

$$I_1 \propto Z_1^2$$

The first part 31 may thus be configured to generate an intensity $I_1$ of inspection radiation smaller than the intensity $I_2$ of the inspection radiation 30 generated by the second part 32, e.g. $I_1$ may be negligible compared to the intensity $I_2$ of the inspection radiation 30 generated by the second part 32. In some examples, $$I_1 \ll I_2.$$

In some examples:

$$\frac{I_2}{I_1} \geq 25.$$

Figure 6:
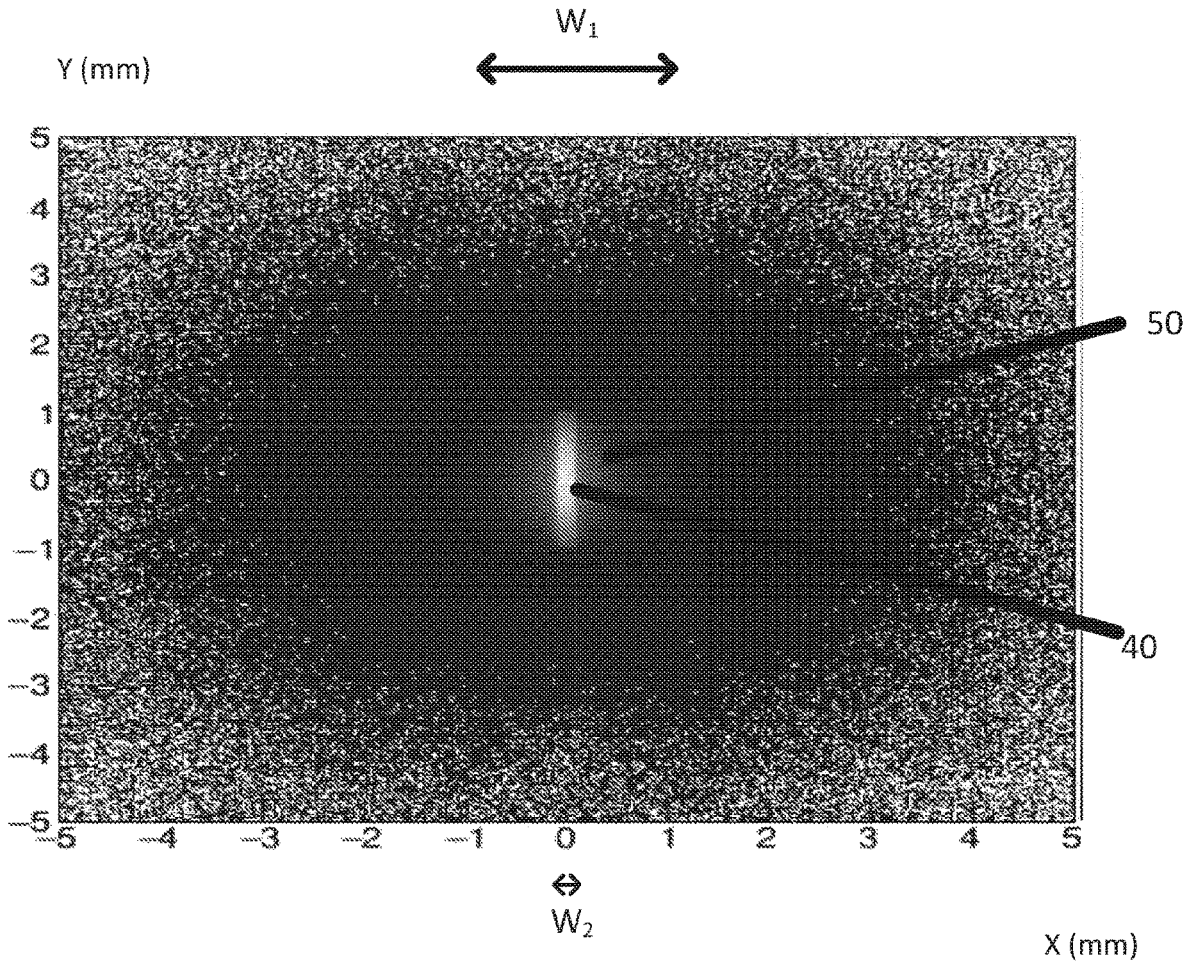
FIG. 6 schematically illustrates an example spatial extension of a focal spot for a source according to for example FIG. 3 or 4, in which the central part corresponds to a high intensity of X-rays.

As illustrated in FIG. 6, the second width $W_2$ of the second part 32 is smaller than the first width $W_1$ of the impact area 50. The width of the focal spot 40 is smaller than the first width $W_1$ of the impact area 50. According to some simulations, the width $W_2$ of the focal spot 40 may be reduced by a factor six (6) compared to the width W illustrated in FIG. 2.

In embodiments, a width of a slit of a collimator for the inspection radiation generated by the focal spot 40 corresponding to the second part 32 may be relatively decreased, compared to a width of a slit of a collimator for the inspection radiation generated by a focal spot corresponding to the whole impact area, as e.g. in a case illustrated in FIG. 2. As a first approximation, the width of a slit of a collimator may be reduced by 25%, compared to the width of a slit of a collimator in a case of e.g. FIG. 2. Alternatively or additionally, the collimator may be located closer to the focal spot 40, compared to collimators in a case of e.g. FIG. 2. Alternatively or additionally, the collimators and/or shielding (the shielding being located e.g. behind detectors for the inspection radiation) may also be relatively smaller for apparatuses using the inspection radiation sources according to the present disclosure. Collimators and/or shielding for apparatuses using the inspection radiation sources according to the present disclosure may be relatively lighter and cheaper.

Alternatively or additionally, as a first approximation, the dose to cargo may be reduced by 20%, compared to the dose to cargo in a case of e.g. FIG. 2.

Alternatively or additionally, the radiation safety length may be reduced by 10%, compared to the radiation safety length in a case of e.g. FIG. 2.

Alternatively or additionally, as a first approximation, the area of radiation safety perimeters may be decreased by 20%, compared to the area of radiation safety perimeters in a case of e.g. FIG. 2.

Alternatively or additionally, as a first approximation, the maximum achievable radiation dose may be decreased by a factor five (5) compared to the maximum achievable radiation dose in a case of FIG. 2. It should be understood that a compromise may be struck between dimensions of the second part and the maximum achievable radiation dose: the smaller the second part, the lower the maximum achievable radiation dose.

In some examples, the intensity of the inspection radiation 30 is a function of the second width $W_2$ of the second part 32.

In relatively high dose rate apparatuses (e.g. such as for a dose rate >5Gy/h at one meter from the focal spot), penetration of the X-rays in the cargo may be increased.

In embodiments of the present disclosure, the second atomic number $Z_2$ may be such that:

$$Z_2 \geq 20.$$

In some examples, the second atomic number $Z_2$ may be such that:

$$Z_2 \geq 50.$$

In embodiments of the present disclosure, the first atomic number $Z_1$ may be such that:

$$Z_1 \leq 20.$$

In some examples, the first atomic number $Z_1$ may be such that:

$$Z_1 \leq 10.$$

It should be understood that the first material and the second material may be such that they do not melt when exposed to the electron current 20.

The first width $W_1$ of the impact area 50 may be such that:

$$W_1 \leq 5 \text{ mm}.$$

In some examples, the first width $W_1$ of the impact area 50 may be such that:

$$W_1 \leq 2 \text{ mm}$$

However it should be understood that the electron current 20 may comprise a first width $W_1$ such that:

$$0 < W_1.$$

In the example of FIG. 3, the first part 31 is configured to inhibit propagation of the electron current 20, e.g. hitting the impact area 50. In the example of FIG. 3, the first part 31 is configured to inhibit propagation of the electron current 20, e.g. emitting an amount of X-rays which is negligible for inspection or detection purposes and/or which is negligible compared to an amount of X-rays emitted by the second part 32, e.g. such as:

$$\frac{I_2}{I_1} \geq 25.$$

In some examples, the first part 31 may be configured to inhibit propagation by absorbing the electron current 20. In the example of FIG. 3, the first part 31 is configured to absorb the electron current 20, e.g. emitting an amount of X-rays which is negligible for inspection or detection purposes and/or which is negligible compared to an amount of X-rays emitted by the second part 32. In some examples and as illustrated in FIG. 3, the first part 31 may have a third width $W_3$ in the direction (Ox) substantially perpendicular to the electron current 20. The third width $W_3$ may be greater than the first width $W_1$ of the impact area 50, such that:

$$W_3 > W_1.$$

However it should be understood that the first part 31 may include a third width $W_3$ depending on dimensions of the inspection radiation source.

In the example of FIG. 3, the second width $W_2$ may be such that:

$$0 < W_2 < 2 \text{ mm}.$$

In some examples, the second width $W_2$ may be such that:

$$0.1 \text{ mm} < W_2 \leq 1 \text{ mm}.$$

In the example of FIG. 3, the second part 32 may be facing the electron accelerator 2 and may be exposed, at least partially to the electron current 20.

In examples of the present disclosure, the first part 31 may be configured to support the second part 32. In some examples, the second part 32 may be attached to the first part 31.

In the example of FIG. 3, the first part 31 includes a recess 34, the second part 32 being located in the recess 34 of the first part 31. The second part 32 may be flush with the first part 31, e.g. on a side facing the electron accelerator 2.

Figure 4:
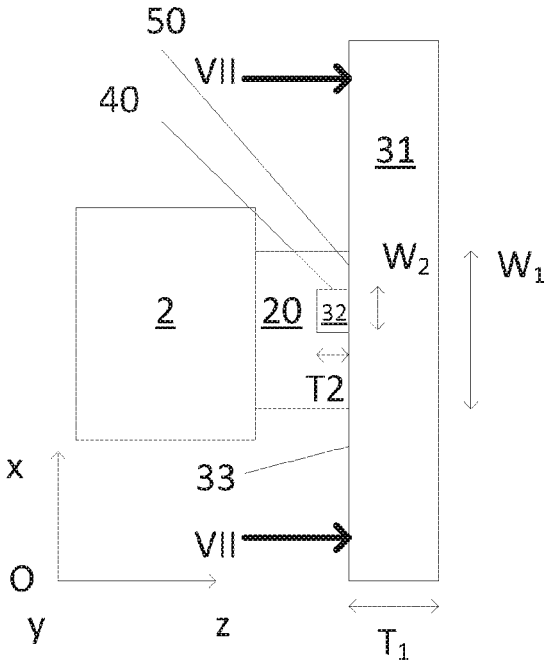
FIG. 4 schematically illustrates a second example inspection radiation source according to the present disclosure.

In the example of FIG. 4, the first part 31 includes a planar surface 33 facing the electron accelerator 2. The second part 32 may be attached (e.g. glued as a non-limiting example) to the planar surface 33 of the first part 33. The second part 32 may not be flush with the first part 31, e.g. on a side facing the electron accelerator 2.

As illustrated in FIGS. 3 and 4, the first part 31 is configured to inhibit propagation of the electron current 20. In some examples, the first part 31 may be configured to absorb the electron current 20. The first part 31 may have a first thickness $T_1$ in a direction (Oz) substantially parallel to the electron current 20. The second part 32 may have a second thickness $T_2$ in the direction (Oz) substantially parallel to the electron current 20. The second thickness $T_2$ may be equal or smaller than the first thickness $T_1$:

$$T_2 \leq T_1.$$

In some examples, the first thickness $T_1$ may be such that:

$$T_1 > 3 \text{ mm}.$$

In some examples, the first thickness $T_1$ may be such that:

$$T_1 > 5 \text{ mm}.$$

However it should be understood that the first part 31 may comprise a first thickness $T_1$ depending on a density of the first material and dimensions of the inspection radiation source.

In some examples, the second thickness $T_2$ may be such that:

$$T_2 \leq 5 \text{ mm}$$

In some examples, the second thickness $T_2$ may be such that:

$$0 < T_2 \leq 0.5 \text{ mm}.$$

T1 and T2 may also be reduced in order to decrease multiple scattering which could enlarge the focal spot. Multiple scattering happens when electron scatter in the target goes out of the target and then produces X-rays by bremsstrahlung.

In some examples the first part 31 may include a material such as carbon. Other materials may be envisaged. In some examples, the second part 32 may include a material such as tungsten. Other materials may be envisaged.

Figure 5:
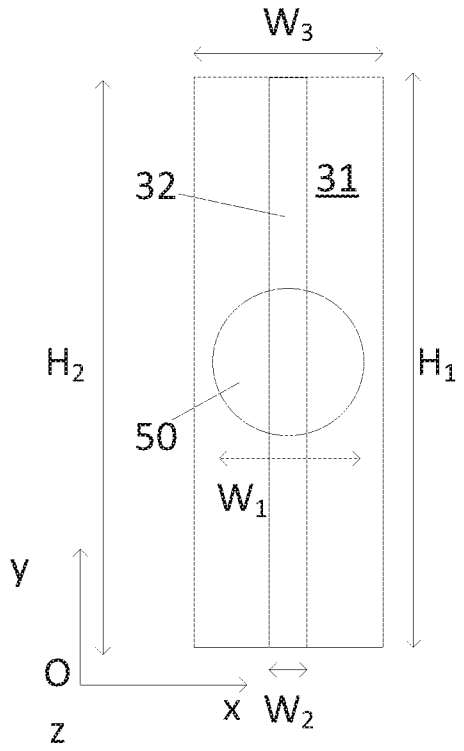
FIG. 5 schematically illustrates an example target as viewed in the direction of arrows V in FIG. 3.
Figure 7:
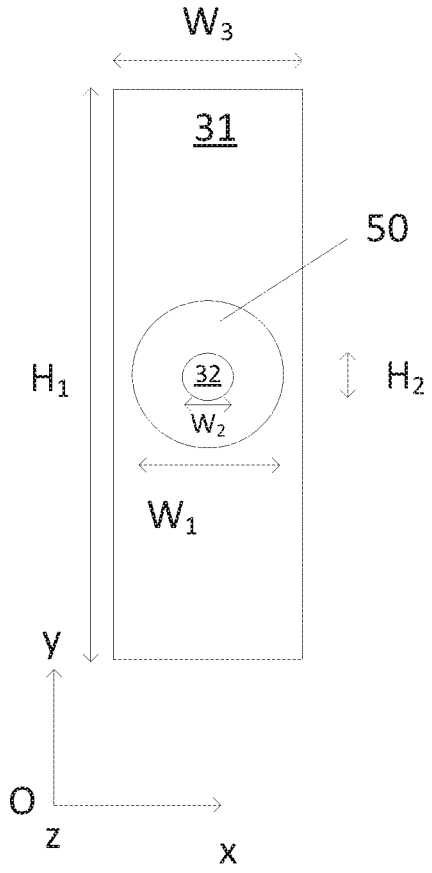
FIG. 7 schematically illustrates an example target as viewed in the direction of arrows VII in FIG. 4.

As illustrated in FIGS. 5 and 7, the first part 31 may have a first height $H_1$ in a further direction (Oy) substantially perpendicular to the electron current 20 (e.g. in the (Oz) direction). The second part 32 may have a second height $H_2$ in the further direction (Oy) substantially perpendicular to the electron current (e.g. in the (Oz) direction). The second height $H_2$ may be equal to, or smaller than, the first height $H_1$, such as:

$$H_2 \leq H_1.$$

As illustrated in FIG. 5, the second part 32 may have a second height $H_2$ equal to the first height $H_1$. Alternatively or additionally, as illustrated in FIG. 7, the second part 32 may have a second height $H_2$ smaller than the first height $H_1$.

However it should be understood that the height $H_1$ of the first part 31 may be larger than the height of the electron current 20, and the height $H_2$ of the second part 32 may be larger or smaller than the height of the electron current 20.

As illustrated in FIG. 5, the second part 32 may have a rectangular parallelepiped shape. Alternatively or additionally, as illustrated in FIG. 7, the second part 32 may have a disc shape.

Figure 8:
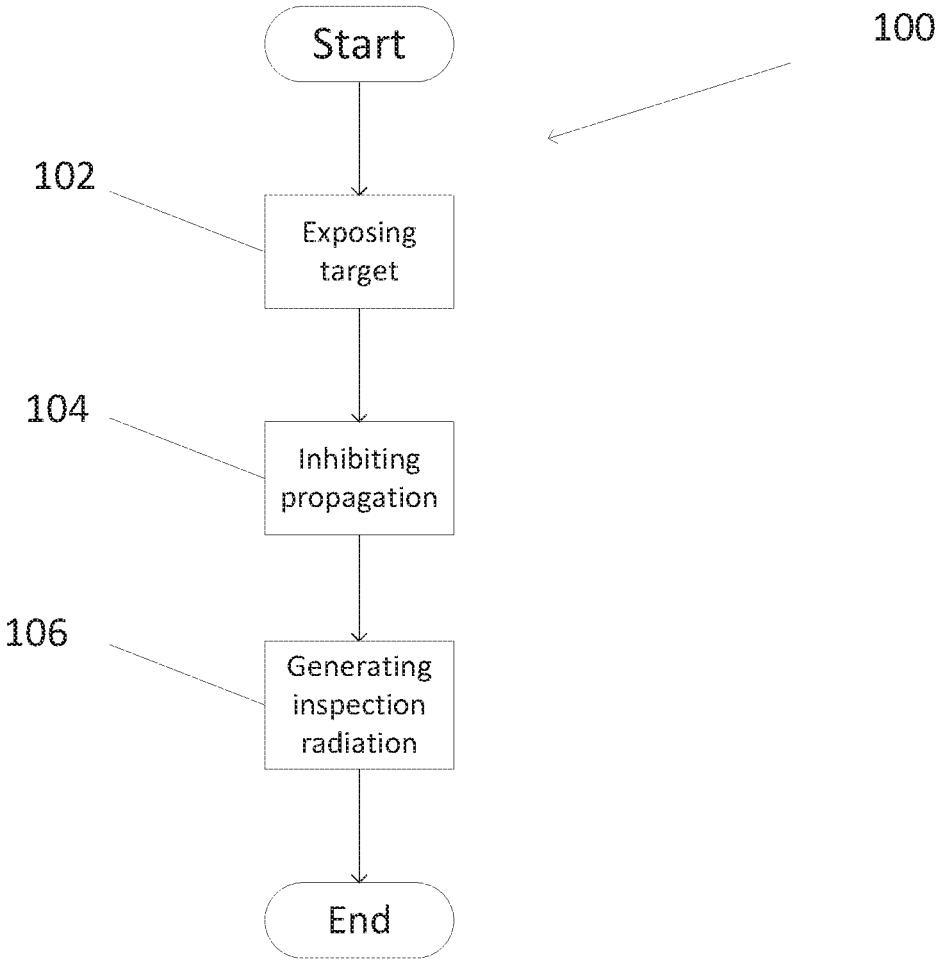
FIG. 8 schematically illustrates a flow chart of an example method according to the present disclosure.

FIG. 8 illustrates an example method 100 of generating an inspection radiation.

The method 100 illustrated in FIG. 8 includes:

exposing on an impact area having a first width, at 102, a target to an electron current generated by an electron accelerator, inhibiting, at 104, propagation of the electron current, using a first part of the target, and generating, at 106, inspection radiation by emitting X-rays, using a second part of the target having a second width smaller than the first width.

In some examples, the method 100 may be performed, at least party, by a source according to some aspects of the present disclosure.

MODIFICATIONS AND VARIATIONS

Other variations and modifications will be apparent to the skilled in the art in the context of the present disclosure, and various features described above may have advantages with or without other features described above.

It should be understood that the target represented in FIG. 5 with reference to FIG. 3 may also be fitted in an example as illustrated in FIG. 4. Similarly the target represented in FIG. 7 with reference to FIG. 4 may also be fitted in an example as illustrated in FIG. 3.

The energy of the X-rays may be comprised between 1 MeV and 15 MeV, and the dose may be comprised between 2mGy and 20Gy (Gray) per minute at 1 meter, for a steel penetration capacity e.g., between 150 mm to 450 mm, typically e.g., 200 mm (7.9 in).

As one possibility, there is provided a computer program, computer program product, or computer readable medium, comprising computer program instructions to cause a programmable computer to carry out any one or more of the methods described herein. In example implementations, at least some portions of the activities related to the source herein may be implemented in software. It is appreciated that software components of the present disclosure may, if desired, be implemented in ROM (read only memory) form. The software components may, generally, be implemented in hardware, if desired, using conventional techniques.

In some examples, components of the source may use specialized applications and hardware.

In some examples, one or more memory elements can store data used for the operations described herein. This includes the memory element being able to store software, logic, code, or processor instructions that are executed to carry out the activities described in the disclosure.

A processor can execute any type of instructions associated with the data to achieve the operations detailed herein in the disclosure. In one example, the processor could transform an element or an article (e.g., data) from one state or thing to another state or thing. In another example, the activities outlined herein may be implemented with fixed logic or programmable logic (e.g., software/computer instructions executed by a processor) and the elements identified herein could be some type of a programmable processor, programmable digital logic (e.g., a field programmable gate array (FPGA), an erasable programmable read only memory (EPROM), an electrically erasable programmable read only memory (EEPROM)), an ASIC that includes digital logic, software, code, electronic instructions, flash memory, optical disks, CD-ROMs, DVD ROMs, magnetic or optical cards, other types of machine-readable mediums suitable for storing electronic instructions, or any suitable combination thereof.

The above embodiments are to be understood as illustrative examples, and further embodiments are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An inspection radiation source comprising:

an electron accelerator for generating an electron current; and a target for the electron current, comprising:

a first part configured to:

be at least partly exposed to the electron current on an impact area having a first width in a direction substantially perpendicular to the electron current, and inhibit propagation of the electron current; and a second part having a second width in the direction substantially perpendicular to the electron current, the second part being configured to:

be at least partly exposed to the electron current, and generate inspection radiation by emitting X-rays in response to being exposed to the electron current, wherein the first part comprises a first material having a first atomic number, and the second part comprises a second material having a second atomic number greater than the first atomic number, the second part attached to the first part and extending away from the first part towards the electron accelerator, such that the second part is closer to the electron accelerator than the first part, wherein the second width of the second part is smaller than the first width of the impact area such that the second part prevents a portion of the impact area from being directly exposed to the electron current but leaves the remainder of the impact area directly exposed to the electron current.

2. The inspection radiation source of claim 1, wherein the second atomic number $Z_2$ is such that:

$$Z_2 \geq 20.$$

3. The inspection radiation source of claim 1, wherein the first atomic number $Z_1$ is such that:

$$Z_1 \leq 20.$$

4. The inspection radiation source of claim 1, wherein the first width $W_1$ is such that:

$$W_1 \leq 5 \text{ mm}.$$

5. The inspection radiation source of claim 1, wherein the first part has a third width $W_3$ in the direction substantially perpendicular to the electron current, the third width $W_3$ being greater than the first width $W_1$ of the impact area, such that:

$$W_3 > W_1.$$

6. The inspection radiation source of claim 1, wherein the second width $W_2$ is such that:

$$W_2 \leq 3 \text{ mm}.$$

7. The inspection radiation source of claim 1, wherein the first part comprises a planar surface facing the electron accelerator, the second part being attached to the planar surface of the first part.

8. The inspection radiation source of claim 1, wherein the first part is configured to absorb the electron current.

9. The inspection radiation source of claim 1, wherein the first part has a first thickness in a direction substantially parallel to the electron current, and the second part has a second thickness in the direction substantially parallel to the electron current, the second thickness being equal or smaller than the first thickness.

10. The inspection radiation source of claim 9, wherein the first thickness $T_1$ is such that:

$$T_1 > 5 \text{ mm}.$$

11. The inspection radiation source of claim 9, wherein the second thickness $T_2$ is such that:

$$T_2 \leq 5 \text{ mm}.$$

12. The inspection radiation source of claim 1, wherein the first part comprises a material such as carbon.

13. The inspection radiation source of claim 1, wherein the second part comprises a material such as tungsten.

14. The inspection radiation source of claim 1, wherein the second part has a rectangular parallelepiped shape or a disc shape.

15. A method of generating an inspection radiation, comprising:

exposing, on an impact area having a first width, a target to an electron current generated by an electron accelerator, and inhibiting, propagation of the electron current, using a first part of the target, and generating, inspection radiation by emitting X-rays, using a second part of the target having a second width, the second part attached to the first part and extending away from the first part towards the electron accelerator, such that the second part is closer to the electron accelerator than the first part, wherein the second width of the second part is smaller than the first width of the impact area such that the second part prevents a portion of the impact area on the first part from being directly exposed to the electron current but leaves the remainder of the impact area on the first part directly exposed to the electron current.

* * * * *